US005131415A

United States Patent [19]

Munoz et al.

[11] Patent Number: 5,131,415

[45] Date of Patent: Jul. 21, 1992

[54] TOBACCO EXTRACTION PROCESS

[75] Inventors: Julio A. Munoz, Walnut Cove; Lila H. O'Connor, Winston-Salem, both of N.C.

[73] Assignee: R. J. Reynolds Tobacco Company, Winston-Salem, N.C.

[21] Appl. No.: 680,207

[22] Filed: Apr. 4, 1991

[51] Int. Cl.[5] ..... A24B 15/24

[52] U.S. Cl. ..... 131/298; 131/297

[58] Field of Search ..... 131/297, 298

[56] References Cited

U.S. PATENT DOCUMENTS

| | | | |
|---|---|---|---|
| 3,136,321 | 6/1964 | Davis . | |
| 3,316,919 | 5/1967 | Green et al. . | |
| 3,398,754 | 8/1968 | Tugman . | |
| 3,500,834 | 3/1970 | Taylor et al. | 131/297 |
| 3,710,803 | 1/1973 | Johnson | 131/297 |
| 3,995,646 | 12/1976 | DeBrunn et al. . | |
| 4,131,117 | 12/1978 | Kite et al. . | |
| 4,131,118 | 12/1978 | Gellatly et al. . | |
| 4,756,318 | 7/1988 | Clearman et al. . | |
| 4,887,618 | 12/1989 | Bernasek et al. . | |
| 4,986,286 | 1/1991 | Roberts et al. . | |
| 5,005,593 | 4/1991 | Fagg . | |

FOREIGN PATENT DOCUMENTS 338831 10/1989 European Pat. Off. .

*Primary Examiner*—V. Millin
*Assistant Examiner*—Lynne Rechard
*Attorney, Agent, or Firm*—Bell, Seltzer, Park & Gibson

[57] ABSTRACT

The present invention relates to a process for providing a tobacco extract. A tobacco material is provided in contact with an extraction solvent. The temperature of the tobacco material and liquid extraction solvent is reduced to below the freezing point thereof to provide a frozen mixture. The temperature of the frozen mixture is then raised to provide a melted portion including the tobacco extract within the liquid extraction solvent. The extract within the solvent preferably has a high soluble solids content (e.g., at least 10 percent by weight of the total weight of the melted portion). If desired, the tobacco extract within the extraction solvent can be further treated (e.g., chemically or physically) to provide or isolate flavorful and aromatic tobacco-derived components of tobacco extract.

31 Claims, 3 Drawing Sheets

TOBACCO EXTRACTION PROCESS

BACKGROUND OF THE INVENTION

The present invention relates to extraction of tobacco components, and in particular to a process for providing a processed tobacco extract.

Popular smoking articles, such as cigarettes, have a substantially cylindrical rod shaped structure and include a charge of smokable material, such as shreds of strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Many types of smoking products and improved smoking articles have been proposed through the years as improvements upon, or as alternatives to, the popular smoking articles. Recently, U.S. Pat. Nos. 4,708,151 to Shelar; 4,714,082 to Banerjee et al; 4,756,318 to Clearman et al; 4,793,365 to Sensabaugh, Jr. et al; 4,827,950 Banerjee et al; 4,893,639 to White; 4,917,128 to Clearman et al; 4,928.714 to Shannon; and 4,938,238 to Barnes et al, and propose cigarettes and pipes which comprise a fuel element, an aerosol generating means physically separate from the fuel element, and a separate mouthend piece. Such types of smoking articles are capable of providing natural tobacco flavors to the smoker thereof by heating without necessarily burning tobacco in various forms.

Natural tobacco flavors are important components of smoking articles and provide tobacco taste and aroma to the smoking article. Thus improved processes for providing natural tobacco flavorful and aromatic substances as well as flavorful and aromatic forms of tobacco are desirable. For example, the formation of a solvent-free aromatic powder prepared by freeze drying tobacco has been proposed in U.S. Pat. No. 3,316,919 to Green. There has also been interest in extracting particular components from tobacco materials and applying the components to tobacco laminae, reconstituted tobacco sheet and other engineered tobacco materials, cigarette filters and other substrates, and the like. For example, various processes for producing and using tobacco extracts, aroma oils and concentrates are proposed in U.S. Pat. Nos. 3,136,321 to Davis; 3,424,171 to Rooker; 4,421,126 to Gellatly 4,506,682 to Mueller and 4,967,771 to Fagg et al and 4,986,286 to Roberts et al, and European Pat. Nos. 338,831 to Clapp et al and 326,370 to Fagg.

It would be highly desirable to provide a tobacco extract which includes tobacco-derived components (e.g., the flavorful and aromatic components) of a tobacco material separated from the extracted tobacco material. Particularly, it would be desirable to provide such a tobacco extract having a high soluble solids content, while avoiding the necessity of subjecting the tobacco material or tobacco extract to conditions, for example, temperatures above about 35° C., which can alter to some degree the chemical character of the tobacco material and tobacco extract, and sometimes can cause the loss of the volatile flavorful and aromatic components thereof.

SUMMARY OF THE INVENTION

The present invention relates to a process for providing a tobacco extract. A tobacco material is provided in contact with an extraction solvent (e.g., a liquid having an aqueous character and preferably essentially pure water). The temperature of the tobacco material and liquid extraction solvent is reduced to below its freezing point to provide a frozen mixture. The temperature of the frozen mixture is then raised to provide a melted portion including the tobacco extract within the liquid extraction solvent, and the extract preferably having a high soluble solids content (e.g., at least 10 percent by weight of the total weight of the melted portion). The process is done at low temperature and low pressure (e.g., at ambient temperature and ambient pressure). An advantage of this is that elevated temperatures above about 35° C. are avoided These elevated temperatures have the propensity to cause the loss of the desired volatile flavorful and aromatic components.

In a preferred embodiment, the tobacco material is extracted with a liquid extraction solvent to provide a tobacco extract in contact with the extraction solvent. The extract in contact with the solvent is preferably absent of insoluble tobacco material (e.g., it has an insoluble solids content of preferably essentially 0 percent and preferably at least less than about 5 percent based on the total weight of tobacco extract). The temperature of the tobacco extract and extraction solvent are reduced to below the freezing point thereof to provide a frozen mixture. The temperature of the frozen mixture is then raised to provide a melted portion. The melted portion includes the tobacco extract within the liquid extraction solvent. Preferably, sufficient frozen mixture (e.g., about 30 to about 60 percent of the total weight thereof) is preferably melted so as to provide the melted portion having a high soluble solids content.

If desired, the tobacco extract within the extraction solvent can be further treated (e.g., chemically or physically) to provide or isolate flavorful and aromatic tobacco-derived components of the tobacco extract.

The tobacco extract and/or the flavorful and aromatic tobacco-derived components provided by the further treatment of the extract are useful in smoking products. For example, such materials can be applied as casing or top dressing components to tobacco strip or cut filler, as well as to other smokable materials. Alternatively, such components are useful in those types of smoking articles described in U.S. Pat. Nos. 4,708,151 to Shelar; 4,714,082 to Banerjee et al; 4,756,318 to Clearman et al; 4,793,365 to Sensabaugh et al; 4,938,236 to Banerjee et al; 4,947,874 to Brooks et al; 4,955,399 to Potter et al; and 4,991,159 to Lawrence et al.

The flavorful and aromatic tobacco-derived components also are useful as cigarette filter additives. For example, the flavor and aromatic components can be combined with polypropylene, polyester or low density polyethylene, and then employed as cigarette filters as described in U.S. Pat. Nos. 4,281,671 to Byrne et al and 4,862,905 to Green, Jr., et al as well as U.S. patent application Ser. No. 606,287, filed Nov. 6, 1990. The flavorful and aromatic tobacco-derived components also are useful as cigarette wrapper additives; or as additives to the inner regions of cigarette packages (e.g., within a paper/foil laminate of cigarette package or within a low density polyethylene film which is placed within a cigarette package) in order to provide a desirable cigarette aroma and "pack aroma."

Additionally, the extracted tobacco material can be further treated and used as a component of reconstituted tobacco material. The extracted tobacco material can also be subjected to further extraction using an extraction solvent to provide additional extract within the solvent.

DETAILED DESCRIPTION OF THE PREFERRED EMBODIMENTS

Figure 1:
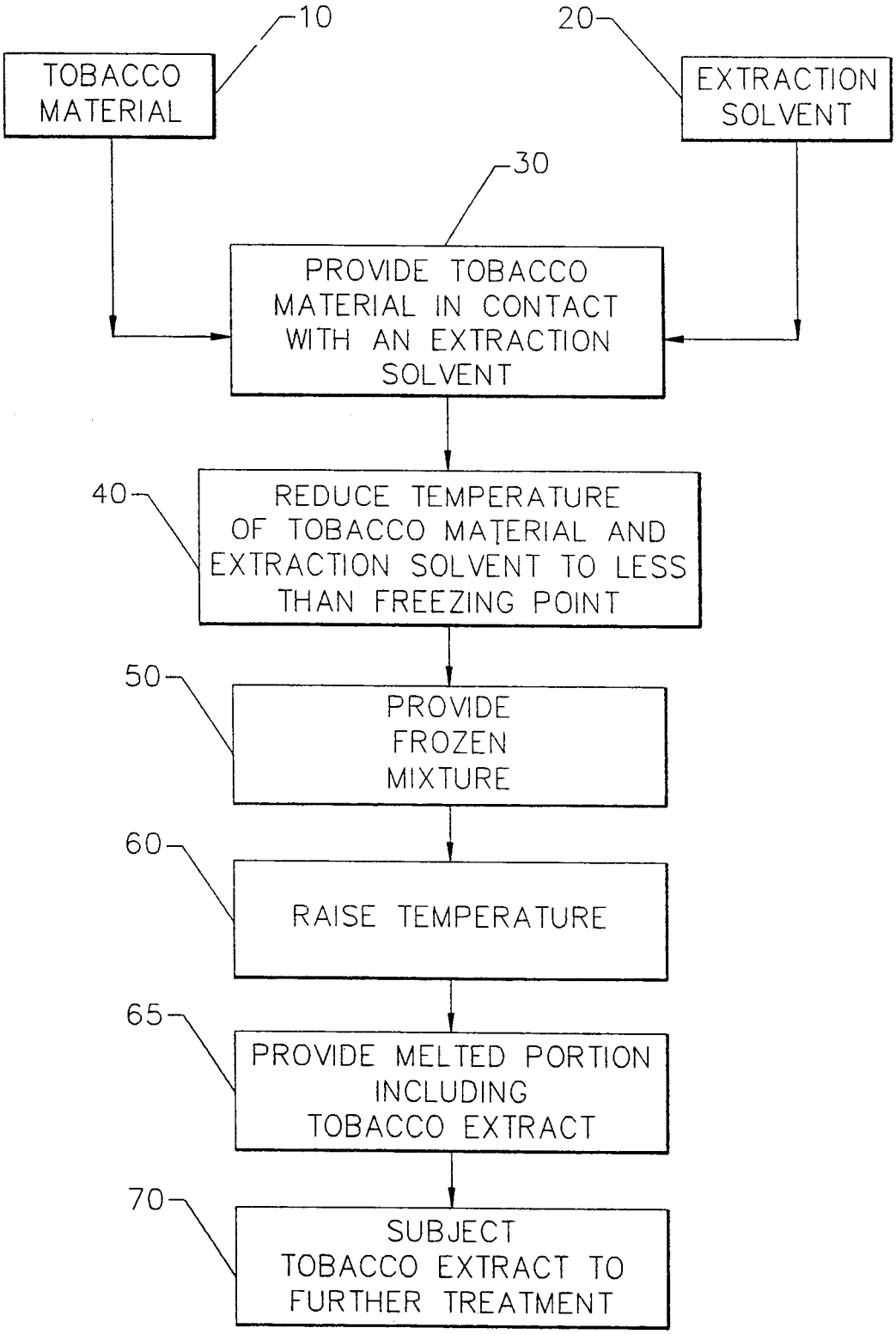
FIGS. 1 and 2 are schematic diagrams of process steps representative of embodiments of the present invention.

Referring to FIG. 1, in one preferred embodiment tobacco material 10 and a liquid extraction solvent 20 are provided 30 and are contacted together so as to provide tobacco extract within the solvent. The temperature of the tobacco material and liquid extraction solvent is reduced 40 to below the freezing point thereof to provide a frozen mixture 50. For purposes of this invention, the term "frozen mixture" relates to a mixture or compound which is frozen completely solid therethrough (i.e., no part of the mixture is in a liquid state). The temperature of the frozen mixture 50 is raised 60 to provide a melted portion 65 including the tobacco extract. For purposes of this invention, the term "melted portion" relates to a portion which was in a frozen state, the temperature thereof was raised and is in a substantially liquid state with substantially no portion thereof in the solid state. Preferably, the temperature is maintained at ambient temperature (e.g., 30° C.) and at ambient pressure (e.g., 1 atm) until about 30 to about 60 percent of the total weight of the frozen mixture is collected. The collected melted portion generally has a soluble solids content of often no more than about 50 percent by weight, below about 20 percent by weight,. and frequently about 13 to 15 percent by weight. By operating at low temperature and pressure conditions, the loss of volatile flavorful and aromatic components is limited. Such a loss of volatile components has a propensity to occur when extracts are exposed to higher temperatures (e.g., greater than about 35° C., particularly greater than about 50° C., and more particularly greater than about 80° C.).

The collected melted portion can also be refrozen, remelted and then recollected to provide yet a further increase in the soluble solids content. Additionally, the tobacco extract is optionally subjected 70 to further treatment (e.g., heat treatment) to further provide or to isolate additional tobacco-derived components (e.g., the flavorful and aromatic components) of the tobacco extract as described in detail herein.

Figure 2:
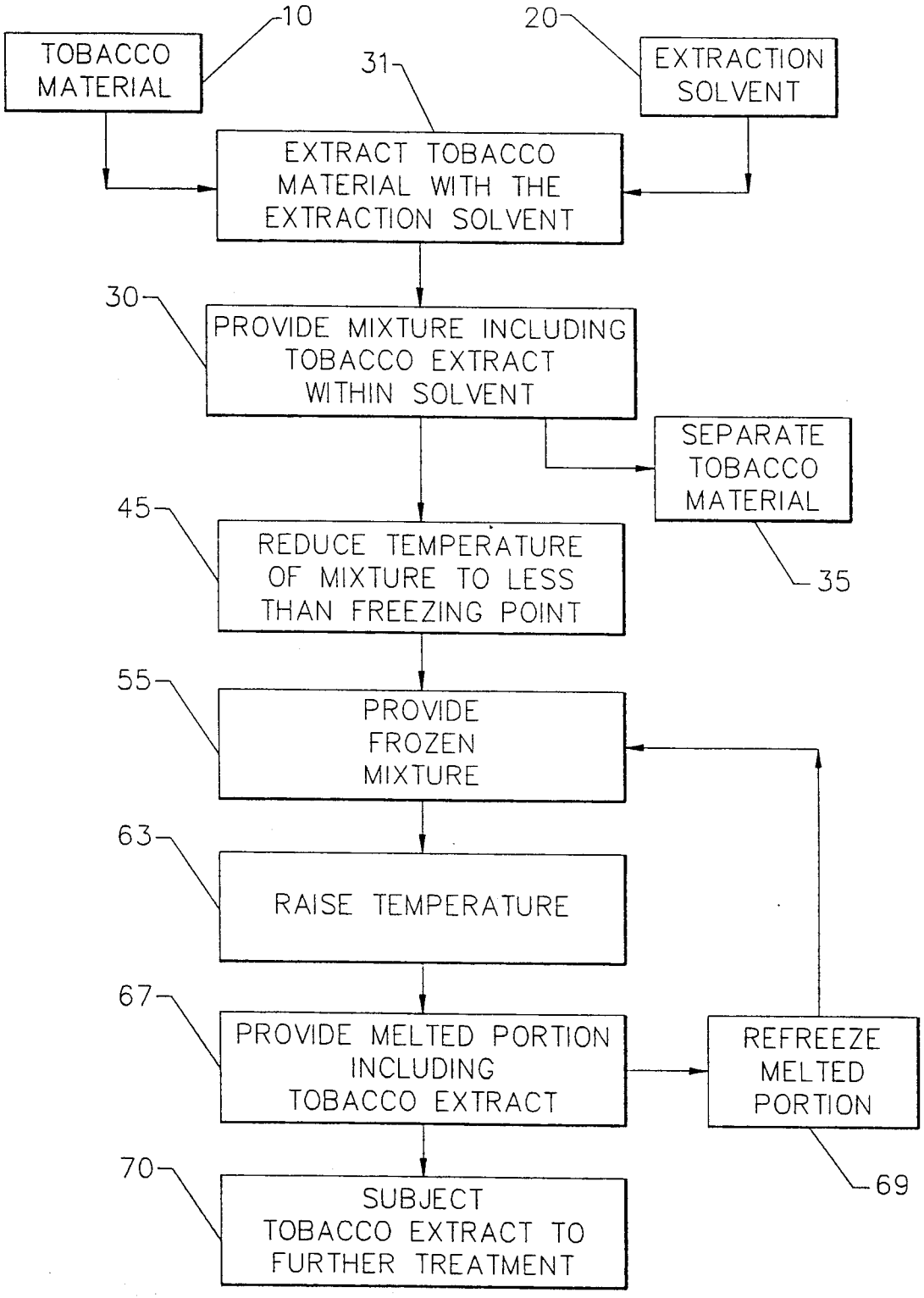

Referring to FIG. 2, another embodiment is illustrated with like numerals indicating aspects common to those in FIG. 1. Tobacco material 10 is extracted 31 with the liquid extraction solvent 20. The tobacco material 10 is separated 35 from the mixture to provide the tobacco extract within the solvent substantially absent of insoluble tobacco material. For purposes of this invention, the term "substantially absent of insoluble tobacco material" relates to the lack of the presence of the insoluble portion of tobacco material, namely the solid tobacco pieces, residues, precipitates, etc. Typically, essentially 0 percent and no more than about 5 percent by weight of the tobacco extract within the solvent is this insoluble portion of the tobacco material. The temperature of the mixture is reduced 45 to below the freezing point thereof to provide a frozen mixture 55. The temperature of the frozen mixture 55 is raised 63 to ambient temperature and ambient pressure, preferably avoiding temperatures of greater than about 35° C. and preferably greater than about 50° C., to provide a melted portion 67 including the tobacco extract within the liquid extraction solvent which is collected. The collected melted portion can be strained to further eliminate any insoluble portions of tobacco material.

The collected melted portion can also optionally be refrozen 69. Additionally, the tobacco extract can optionally be subjected 70 to further treatment to provide or to isolate further flavorful and aromatic tobacco-derived components of the tobacco extract as described in detail herein.

The tobacco materials useful herein can vary. Tobacco materials which are used are of a form such that under extraction conditions a portion thereof is soluble in (i.e., extracted by) an extraction solvent; and a portion thereof is insoluble in (i.e., not extracted by) that extraction solvent. A typical insoluble tobacco material includes components of the biopolymer matrix of the tobacco.

Examples of suitable types of tobaccos include flue-cured, Burley, Maryland and Oriental tobaccos, as well as the rare or specialty tobaccos. The tobacco material generally has been aged, and can be in the form of laminae and/or stem, or can be in processed form. Tobacco waste materials and processing by-products such as fines, dust, scrap, stems and stalks can be employed. Unaged, uncured mature, or immature tobaccos also can be employed. The aforementioned tobacco materials can be processed separately, or as blends thereof.

Tobacco material can be extracted in a number of ways. In particular, the tobacco material is subjected to extraction conditions with a suitable liquid solvent to extract a sufficient amount of the desired components from the tobacco material. The manner in which the tobacco material is extracted, and the type of solvent employed, however can vary. Preferably, the extracted tobacco material is provided by extracting the tobacco material using a liquid having an aqueous character. Such a liquid consists primarily of water, normally greater than about 90 weight percent water, and can be essentially pure water in certain circumstances. For example, an essentially pure water can be distilled water, tap water, or the like. However, a solvent having an aqueous character can include water having substances such as pH buffers, pH adjusters, organic and inorganic salts, sugars, amino acids or surfactants incorporated therein. The solvent also can be a co-solvent mixture of water and minor amounts of one or more solvents which are miscible therewith. The selection and use of other solvents capable of being frozen is within the skill of one in the art.

The extraction can be performed in a wide variety of apparatus. Preferably the extraction is performed at low temperatures (e.g., from about 20° C. to about 35° C.) and low pressure (e.g., about 1 atm). These lower temperature and pressure ranges avoid the loss of volatile flavorful and aromatic components which sometimes occur when elevated temperature (e.g., greater than about 35° C.) and elevated pressure ranges are used.

The extraction is performed at an optimized solvent to tobacco material ratio, namely at a ratio wherein a relatively large amount of extract is extracted from tobacco material using a minimum amount of solvent. Typically, about 3 weight parts solvent for each weight part of tobacco material will adequately extract the extractables. The low amount of solvent relative to tobacco material enables for an efficient use of the freezing and melting processes. Typically, the lower the amount of solvent used, the more concentrated the extract within the solvent will be. Typically, the weight of solvent to tobacco material for extraction is about 4 to about 10 weight parts of solvent for each weight part of tobacco material and preferably is about 6 to about 7 weight parts solvent for each weight part of tobacco material.

Figure 3:
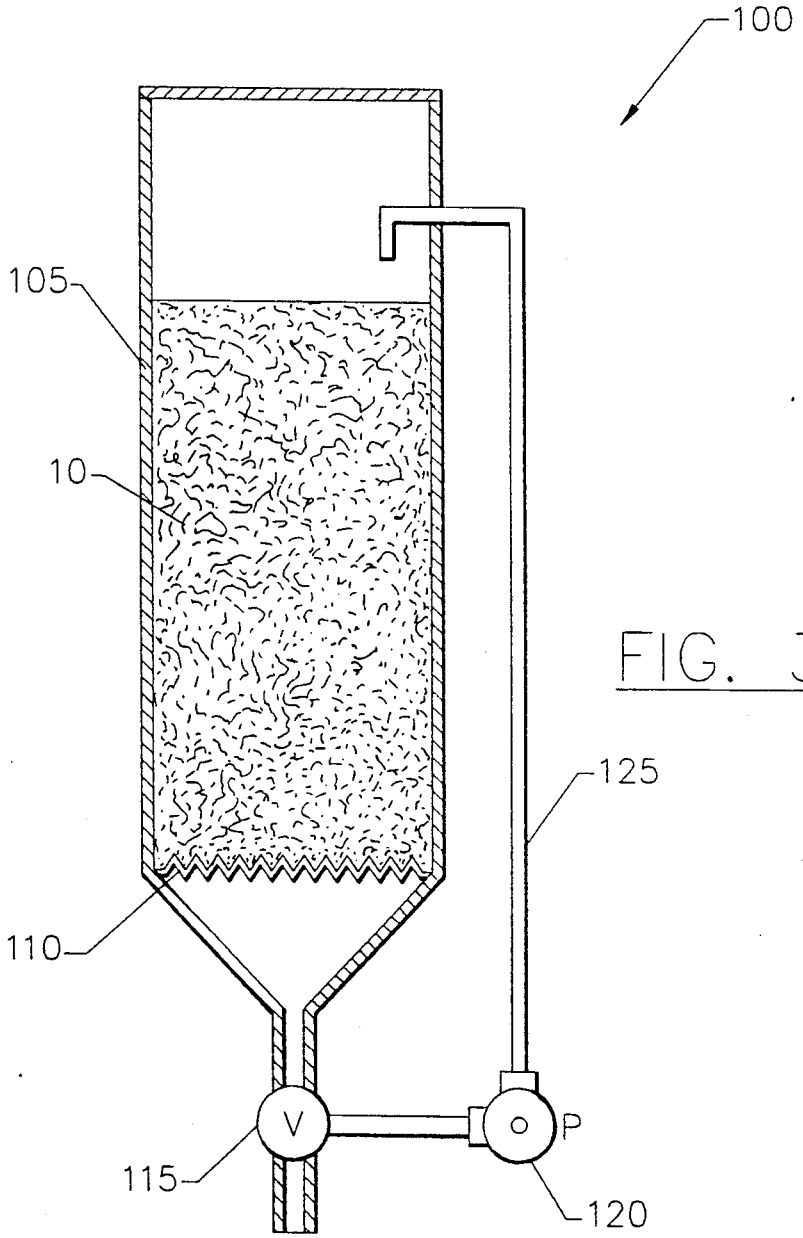
FIG. 3 is a diagrammatic and schematic representation of an apparatus for performing a portion of this invention.

An exemplary apparatus 100 for performing such an extraction having a low extraction solvent to tobacco material ratio is shown in FIG. 3. The apparatus 100 includes a cylindrical column 105. Tobacco material 10 is positioned in the column (e.g., packed and compressed) so as to have a packing density of about 0.5 to about 0.7 pounds of tobacco material per liter of column capacity, and preferably a height to diameter ratio of tobacco material of greater than about 3, and preferably about 5. Preferably, the tobacco material 10 prior to being packed into the column has a moisture content of from about 10 to 20 percent, and preferably about 8 to 15 percent. For purposes of this invention, the term "moisture content" relates to the weight of the water within the tobacco material relative to the total weight of the tobacco material. The cylindrical column 105 preferably has a screen 110 at the bottom thereof for allowing passage of the liquid extract therethrough while preventing passage of insoluble tobacco material.

Solvent (e.g., pure water) is added or otherwise introduced to the top of the cylinder at relatively low temperature and low pressure (i.e., preferably at ambient temperature and at ambient pressure) so as to avoid the loss of volatile flavorful and aromatic components. The solvent level is maintained above the surface of the column of tobacco material 10 by the addition of additional solvent over time. Preferably the addition of solvent is continuous to provide a repetitive extraction of the tobacco material. The rate of addition is proportional to the extraction or elution rate and the removal of extractables from the tobacco material and the incorporation of the tobacco extract into the solvent. The tobacco extract within the solvent is then collected at the bottom of the column 105 through a valve 115 particularly when the solvent is essentially pure water. The extract within the solvent can be passed via a pump 120 through a conduit 125 back to the top of the column 105 and extract passed through the tobacco material one or more additional times and then is collected, particularly when the solvent is not essentially pure water.

Other methods for extracting components from tobacco materials will be apparent to the skilled artisan. For example, the tobacco material can be extracted batch-wise or in a continuous manner. Representative methods for extracting tobacco materials are set forth in U.S. patent application Ser. Nos. 484,587, filed Feb. 23, 1990 and 505,339, filed Apr. 5, 1990, as well as U.S. Pat. No. 5,005,593 to Fagg, the disclosures of which are herein incorporated by reference.

A wide variety of components can be extracted from the tobacco material. The particular components and the amounts of the particular components which are extracted often depend upon the type of tobacco material which is processed, the properties of the particular solvent, and the specific extraction conditions (e.g., including the temperature and pressure at which the extraction occurs, the time period over which the extraction is carried out, the packing density of the extraction column, etc.). Typically, at least about 20 percent, preferably about 25 percent, more preferably about 30 percent, and most preferably at least about 35 percent of the weight of the starting tobacco material (on a dry weight basis) is extracted and the extract is separated from the extracted tobacco material. For example, about 40 percent to about 50 percent of the weight of tobacco material can be extracted using essentially pure water extraction solvent and using the packed cylindrical column shown in FIG. 3. Pure water extraction solvent will most often extract primarily and substantially all of the water soluble components of the tobacco material. Preferably, the resulting tobacco extract within the liquid extraction solvent has an insoluble tobacco material content of essentially 0 percent and preferably no more than about 5 percent by weight based on the total weight of the tobacco extract within the solvent.

Optionally, the tobacco extracted material can be physically separated from any remaining tobacco extract within the solvent using conventional separation techniques such as presses, filters, centrifuges, screw presses, rotating disk presses, converging belts, or the like. The additional tobacco extract within the solvent can be combined with the previous collected extract within the solvent. Additionally, the tobacco material can be contacted with the extraction solvent and this entire mass frozen before extraction.

The mixture is collected or transferred to one or more freezing vessels (not shown) the sizes of which can vary. The temperature of the vessel and the mixture is reduced to below the freezing point thereof, such as in a freezing chamber.

During freezing, the extract within the solvent preferentially freezes and is a non-homogeneous frozen mixture. The essentially pure or low solvent concentration portion of the extract is normally heavier and more dense. This results in the frozen mixture being non-homogeneous and having a visible gradient of light-in-color (i.e., low concentration of extract) at the top and dark brown-in-color (i.e., high concentration of extract portion) at the bottom. Optionally, the frozen mixture can be broken up into several pieces before being melted or the mixture can be collected in a plurality of vessels.

Preferably, the rate of temperature reduction is about 5° C./hour for each liter of mixture. The rate of freezing on exposure to low temperature is dependent, for example, on the volume and weight of mixture, the liquid extraction solvent, the freezing vessel size (and the size of frozen mixture desired), the characteristics of the freezing vessel and the like. Typically, the freezing point of the mixture approximates that of the pure solvent at ambient pressure. For example, if pure water is the liquid extraction solvent, the temperature is reduced to below about 0° C. at ambient pressure.

The temperature of the frozen mixture is then raised slowly by exposure over a controlled and extended period of time to ambient temperature and ambient pressure to reduce the possibility of the loss of volatile flavorful and aromatic components of the extract. Optionally, the frozen mixture can be exposed to mild heat (i.e., utilizing heat lamps while avoiding drying the mixture by removing the solvent). Other means of raising the temperature while avoiding temperatures above about 35° C. and preferably avoiding temperatures above about 50° C. will be apparent to those skilled in the art. The frozen mixture is preferably placed in a horizontal position or is melted in the same position as it was frozen (e.g., with the light-in-color low concentration of extract portion on top and the dark brown high concentration of extract portion on the bottom). The frozen mixture is melted and the melt collected separately from the freezing vessel. For example, the freezing vessel can include a valve at the bottom thereof wherein when opened the melted portion flows through and is collected in a separate vessel. This melted portion has a high solvent solids content (i.e., greater than about 10 percent based on the total weight of the extract within the solvent). The soluble solids content can be monitored using a conventional refractometer. Thus, by melting a controlled and predetermined amount of the frozen mixture, an extract within the solvent having a high soluble solids content can be obtained. For example, if about 30 to about 60 percent of the total weight of the frozen mixture is melted, the extract within the solvent often has a soluble solids content of from about 10 to about 50 percent by weight. Moreover, the frozen mixture remaining can be further melted to provide an additional melted portion having a very low soluble solids content (e.g., less than about 1 percent by weight based on the total weight of the portion).

The tobacco extract in liquid form and preferably having a high solids soluble content can be subjected to additional treatment to further provide or isolate flavorful and aromatic tobacco-derived components. For example, the tobacco extract can be employed as described in U.S. Ser. No. 484,587 filed Feb. 23, 1990 the disclosure of which is herein incorporated by reference. Alternatively, the extract can be spray dried such as described in U.S. Pat. No. 3,398,754 to Tughan; spray dried and processed such as described in U.S. Pat. No. 5,005,593 to Fagg; or can be freeze dried such as described in U.S. Pat. No. 3,316,198 to Green the disclosures of which are incorporated herein by reference.

The tobacco extract can also be fermented within a fermentation bath preferably including at least one strain of yeast such as described for example, in U.S. Ser. No. 505,327 filed Apr. 5, 1990, the disclosure of which is incorporated herein by reference. The tobacco extract can optionally be subjected to heat treatment in a pressure controlled environment. Such a pressure controlled environment is described, for example, in U.S. Ser. No. 451,175, filed Dec. 18, 1989, the disclosure of which is incorporated herein by reference. Conditions provided during the optional heat treatment most desirably are such that certain components of the tobacco extract or tobacco material undergo Maillard reactions or "browning reactions". This reaction is facilitated by adding one or more sugars (e.g., fructose, sucrose, glucose, maltose) and/or one or more amino acids or amino acid analogs (e.g., glutamine, asparagine, proline, alanine, cystine, aspartic acid, phenylalanine, glutamic acid), to the extract, prior to treatment in a pressure vessel.

The tobacco extract and the collected flavorful and aromatic tobacco-derived components derived from further treatment thereof are used in various forms in the manufacture of smoking articles. For example, the tobacco-derived components can be contacted with tobacco and employed as a form of tobacco in smoking article manufacture. For example, tobacco cut filler, as well as the types of smokable materials described in U.S. Pat. No. 4,920,990 to Lawrence et al, the disclosure of which is incorporated herein by reference, can be coated or otherwise blended with about 0.001 to about 1 percent by weight of the flavorful and aromatic tobacco-derived components, based on the weight of the particular smokable material. Furthermore, the tobacco extract may be combined with aerosol forming materials, and employed in the manufacture of those smoking articles described in U.S. Pat. Nos. 4,708,151 to Shelar; 4,714,082 to Banerjee et al; 4,756,318 to Clearman et al; 4,771,795 to White et al; 4,793,365 to Sensabaugh et al; 4,917,128 to Clearman et al; 4,938,236 to Banerjee et al; and 4,947,874 to Brooks et al; 4,955,399 to Potter et al; and 4,991,159 to Lawrence et al, the disclosures of which are incorporated herein by reference. In addition, the coated tobacco can be incorporated into those smoking articles described in U.S. patent application Ser. No. 414,833 filed Sep. 29, 1989 and European Patent Publication No. 280,990, the disclosures of which are incorporated herein by reference.

The tobacco extract can also be contacted and processed with a substrate such as described, for example, in U.S. Pat. No. 4,986,286 to Roberts et al, the disclosure of which is incorporated herein by reference. Preferred substrates are normally solid materials and are thermally stable at those temperatures experienced during the heat treatment steps described therein.

If desired, the physical and/or chemical composition of the extracted tobacco material can also be altered. The extracted tobacco material can be reformed, cut to a desired size or shape, or otherwise physically treated, particularly when the extracted tobacco material is in a fairly moist form. In particular, the extracted tobacco material can be treated by a volume expansion process such as described in U.S. Ser. No 505,339 to Poindexter et al filed Apr. 5, 1990, the disclosure of which is incorporated herein by reference. The extracted tobacco material can be heat treated or otherwise physically processed to change the chemical composition of that material. In particular, the extracted tobacco material can be subjected to enzyme treatment (as set forth in U.S. Pat. No. 4,887,618 to Bernasek et al, the disclosure of which is incorporated herein by reference), reacted with certain agents or fermented, further extracted (e.g., an extracted tobacco material provided from an extraction of a tobacco material with an aqueous solvent can be subjected to extraction conditions using a hydrophobic solvent, such as hexane). The extracted tobacco material can be deproteinized and reapplied to the extracted tobacco material or can be combined with the tobacco extract within the solvent to provide certain types of processed tobacco materials, (e.g., reconstituted filler material) or combined at later stages with the tobacco extract of the present invention.

The following examples are provided in order to further illustrate various embodiments of the invention but should not be construed as limiting the scope thereof. Unless otherwise noted, all parts and percentages are by weight.

EXAMPLE 1

A 22 pound (dry weight basis) sample of aged flue-cured tobacco in cut filler form having about an 8.5% moisture content is placed in a stainless steel column cylindrical having a 38 l working volume (i.e., that volume which is to be occupied by tobacco material). The tobacco material is placed in the column so that there is about 0.6 lbs of tobacco material per liter of working volume capacity, i.e., a height to diameter ratio of the tobacco material to the column of about 5:1 and about 9.5 l of the working volume being taken up by tobacco material.

Extraction with tap water as the extraction solvent is conducted at ambient temperature (e.g., about 30° C.) and ambient pressure (e.g., about 1 atm). Initially about 30 l of water is added, 5 l at a time so as to provide an extraction rate of normally about 1 l/5 min. The water goes through slowly, and there is a tendency of the tobacco material becoming moist and the extraction rate slowing down.

The extraction solvent level is maintained above the surface of the tobacco material by adding an additional 30 l of water. About 30 l of mixture including the tobacco extract within the extraction solvent is collected with about a 14.8% soluble solid content based on the total weight of the extract within the solvent and as measured by a standard refractomer available from Fischer Products. The mixture is absent (i.e., including essentially 0 percent) of insoluble tobacco material. The mixture is a dark brown viscous liquid, and has a strong tobacco aroma.

The mixture is then collected in a 30 l polyethylene pail and placed in a walk-in type freezer maintained at a temperature of −5° C. to −10° C. and frozen overnight into a solid mass.

The frozen mixture, which is darker at the bottom and light-in-color on top, is removed from the freezer, positioned on its side in a horizontal orientation and, thawed at room temperature. After about 30 minutes, the frozen mixture begins to melt and about one half of the total weight of the frozen mixture is collected as a liquid over a 3 hour period. This melted portion is a dark brown viscous liquid and, has a strong tobacco aroma. The soluble solids content of this portion as measured by a refractometer is about 30 percent based on the total weight of the melted portion of the tobacco extract within the extraction solvent.

The remaining half of the frozen mixture is further melted and collected. This portion has a weak tobacco color and aroma and is not very viscous. Its soluble solids content is about 1 percent based on total weight of the portion collected.

EXAMPLE 2

A 3.85 pound (dry weight basis) sample of aged flue-cured tobacco in cut filler form having about an 8.5% moisture content is placed in a five gallon polyethylene pail. About 11 liters of tap water is gradually added until the water line is just above the top of the tobacco material. The tobacco material is allowed to sit and the solvent soaked into the tobacco material at ambient temperature and pressure for 30 minutes.

The tobacco material and solvent is placed in a walk-in type freezer maintained at a temperature of −5° C. to −10° C. and frozen for 48 hours into a solid frozen mass. The frozen mixture, is removed from the freezer, positioned on its side in a horizontal orientation, and thawed at room temperature. After about 30 minutes, the frozen mixture begins to melt and about one fifth of the total weight of the frozen mixture is collected over an 8 hour period. This melted portion is a dark brown somewhat viscous liquid and has a tobacco aroma. The soluble solids content of this portion as measured by a refractometer is about 9 percent based on the total weight of the melted portion of the tobacco extract within the extraction solvent.

That which is claimed is:

1. A process for providing a tobacco extract, the process comprising:

(a) combining a tobacco material and extraction solvent;

(b) reducing the temperature of the tobacco material and the extraction solvent to below the freezing point thereof to provide a frozen mixture; and (c) raising the temperature of the frozen mixture to provide a melted portion including a tobacco extract within the extraction solvent.

2. A process according to claim 1 whereby the extraction solvent is a liquid having an aqueous character.

3. A process according to claim 2 whereby step (b) includes reducing the temperature to less than 0° C. at ambient pressure.

4. A process according to claim 3 whereby step (c) includes raising the temperature of the frozen mixture to ambient temperature and ambient pressure.

5. A process according to claim 1 or 4 whereby the temperature of the frozen compound is maintained at ambient temperature until about 30 to about 60 percent of the total weight of the frozen mixture is melted and the melted portion including the tobacco extract within the extraction solvent has a soluble solids content of from about 10 percent to about 50 percent by weight based on the total weight of the melted portion.

6. The process according to claim 5 further including the additional steps of:

(d) reducing the temperature of the melted portion including the tobacco extract within the solvent to below the freezing point thereof to provide a frozen portion and (e) raising the temperature of the frozen portion to provide a re-melted portion including the tobacco extract within the solvent.

7. A process according to claim 1 further comprising the step of treating the tobacco extract to provide tobacco-derived components thereof.

8. A process for providing a tobacco extract, the process comprising;

(a) providing a tobacco extract in contact with an extraction solvent;

(b) reducing the temperature of the tobacco extract and the extraction solvent to below the freezing point thereof to provide a frozen mixture; and (c) raising the temperature of the frozen mixture to provide a melted portion including a tobacco extract within the extraction solvent.

9. A process according to claim 8 whereby the tobacco extract in contact with the extraction solvent in step (b) is substantially absent of insoluble tobacco material.

10. A process according to claim 8 whereby the extraction solvent is a liquid having an aqueous character.

11. A process according to claim 10 whereby step (b) includes reducing the temperature to less than 0° C. at ambient pressure.

12. A process according to claim 11 whereby step (c) includes raising the temperature of the frozen mixture to ambient temperature at ambient pressure.

13. A process according to claim 8 or 12 whereby the temperature of the frozen compound is raised to ambient temperature until about 30 to about 60 percent of the total weight of the frozen mixture is melted and the melted portion including the tobacco extract has a soluble solids content from about 10 percent to about 50 percent by weight based on the total weight of the melted portion.

14. The process according to claim 13 further including the steps of:

(d) reducing the temperature of the melted portion including the tobacco extract within the solvent to below the freezing point thereof to provide a frozen portion and (e) raising the temperature of the frozen portion to provide a re-melted portion including the tobacco extract within the solvent.

15. A process according to claim 8 further comprising the step of treating the tobacco extract to provide tobacco-derived components thereof.

16. A process for providing a tobacco extract, the process comprising:

(a) extracting a tobacco material using an extraction solvent to provide a mixture including a tobacco extract with the solvent;

(b) reducing the temperature of the mixture to below the freezing point of the mixture to provide a frozen mixture; and (c) raising the temperature of the frozen mixture to provide a melted portion including the tobacco extract, the tobacco extract having a soluble solids content of at least about 10 percent by weight based on the total weight of the melted portion.

17. A process according to claim 16 whereby the tobacco extract in contact with the extraction solvent in step (b) is substantially absent of insoluble tobacco material.

18. A process according to claim 16 whereby the extraction solvent is a liquid having an aqueous character.

19. A process according to claim 17 whereby step (b) includes reducing the temperature to less than 0° C. at ambient pressure.

20. A process according to claim 18 whereby step (c) includes raising the temperature of the frozen mixture to ambient temperature at ambient pressure.

21. A process according to claim 16 or 20 whereby the temperature of the frozen compound is raised to ambient temperature until about 30 to about 60 percent of the total weight of the frozen compound is melted and the melted portion including the tobacco extract has a soluble solid contents from about 10 percent to about 50 percent by weight based on the total weight of the melted portion.

22. The process according to claim 21 further including the steps of:

(d) reducing the temperature of the melted portion including the tobacco extract within the solvent to below the freezing point thereof to provide a frozen melted portion and (e) raising the temperature of the frozen portion to provide a re-melted portion including the tobacco extract within the solvent.

23. A process according to claim 16 further comprising the step of treating the tobacco extract to provide tobacco-derived components thereof.

24. A process for providing a tobacco extract, the process comprising:

(a) providing a tobacco material positioned within a cylindrical column having a packing density of at about 0.5 to about 0.7 pounds of tobacco material per liter of column capacity;

(b) extracting the tobacco material with an extraction solvent by passing the extraction solvent through the tobacco material within the cylindrical column to provide a tobacco extract in contact with the extraction solvent;

(c) reducing the temperature of the tobacco extract and the extraction solvent to below the freezing point thereof to provide a frozen mixture; and (d) raising the temperature of the frozen mixture to provide a melted portion including the tobacco extract within the extraction solvent.

25. A process according to claim 24 whereby the tobacco extract in contact with the extraction solvent of step (a) is substantially absent of insoluble tobacco material.

26. A process according to claim 24 whereby the extraction solvent is a liquid having an aqueous character.

27. A process according to claim 24 whereby step (b) includes reducing the temperature to less than 0° C. at ambient pressure.

28. A process according to claim 24 whereby step (c) includes raising the temperature of the frozen mixture to ambient temperature at ambient pressure.

29. A process according to claim 24 or 28 whereby the temperature of the frozen compound is raised to ambient temperature until about 30 to about 60 percent of the total weight of the frozen mixture is melted and the melted portion including the tobacco extract has a soluble solids content from about 10 percent to about 50 percent by weight based on the total weight of the melted portion.

30. The process according to claim 29 further including the steps of:

(d) reducing the temperature of the melted portion including the tobacco extract within the solvent to below the freezing point of the tobacco extract and extraction solvent to provide a frozen melted portion (e) raising the temperature of the melted portion to provide a re-melted portion including the tobacco extract within the solvent.

31. A process according to claim 24 further comprising the step of treating the tobacco extract to provide tobacco-derived components thereof.

* * * * *